US007329167B2

(12) United States Patent
Nagasaka et al.

(10) Patent No.: US 7,329,167 B2
(45) Date of Patent: Feb. 12, 2008

(54) MULTI-AXLE RUNNING TOY AND MULTI-AXLE RUNNING TOY SET

(75) Inventors: Yoshizo Nagasaka, Nagareyama (JP); Hiroyuki Watanabe, Kokubunji (JP)

(73) Assignees: Tomy Company, Ltd., Tokyo (JP); Imagic, Inc., Tokyo (JP)

( * ) Notice: Subject to any disclaimer, the term of this patent is extended or adjusted under 35 U.S.C. 154(b) by 278 days.

(21) Appl. No.: 10/944,182

(22) Filed: Sep. 20, 2004

(65) Prior Publication Data

US 2005/0090180 A1 Apr. 28, 2005

(30) Foreign Application Priority Data

Oct. 24, 2003 (JP) ..... 2003-364965

(51) Int. Cl.
*A63H 17/00* (2006.01)
*A63H 17/267* (2006.01)

(52) U.S. Cl. ..... 446/465; 446/437; 446/462

(58) Field of Classification Search ..... 446/437, 446/462, 465

See application file for complete search history.

(56) References Cited

U.S. PATENT DOCUMENTS

| | | | | | |
|---|---|---|---|---|---|
| 1,498,427 | A | * | 6/1924 | Dean | 280/1.192 |
| 1,663,169 | A | * | 3/1928 | Marx | 446/437 |
| 1,759,740 | A | * | 5/1930 | Foltz | 280/1.192 |
| 2,247,354 | A | * | 7/1941 | Berger | 446/437 |
| 2,677,216 | A | * | 5/1954 | Hein | 446/462 |
| 2,778,159 | A | * | 1/1957 | Irwin | 446/465 |
| 3,955,429 | A | * | 5/1976 | Holden | 74/64 |
| 3,968,593 | A | * | 7/1976 | Lin | 446/462 |
| 4,193,639 | A | * | 3/1980 | Pauly et al. | 301/35.61 |
| 4,443,967 | A | * | 4/1984 | Jones et al. | 446/462 |
| 4,459,776 | A | * | 7/1984 | Jaworski et al. | 446/462 |
| 4,468,884 | A | * | 9/1984 | Goldfarb et al. | 446/462 |
| 4,518,176 | A | * | 5/1985 | Hegedus | 280/229 |
| 4,575,354 | A | * | 3/1986 | Wakayama et al. | 446/437 |
| 4,576,583 | A | | 3/1986 | Yoneda | |
| 5,167,563 | A | * | 12/1992 | Saffer | 446/465 |
| 5,762,533 | A | * | 6/1998 | Tilbor et al. | 446/466 |
| 5,909,889 | A | * | 6/1999 | Larson | 280/229 |
| 6,106,362 | A | | 8/2000 | Keller et al. | |
| 6,264,283 | B1 | * | 7/2001 | Rehkemper et al. | 301/5.1 |
| 2002/0068503 | A1 | | 6/2002 | Watanabe | |

FOREIGN PATENT DOCUMENTS

| | | |
|---|---|---|
| EP | 1120143 | 8/2001 |
| GB | 2216025 | 10/1989 |
| JP | 3078134 | 3/2001 |
| WO | WO 01/72391 | 10/2001 |

OTHER PUBLICATIONS

European Search Report dated Feb. 23, 2005 in Application No. 04105162.

* cited by examiner

*Primary Examiner*—John A. Ricci
(74) *Attorney, Agent, or Firm*—Staas & Halsey, LLP

(57) ABSTRACT

A multi-axle running toy includes: a flywheel to serve as a driving source; three or more drive axles driven by rotation of the flywheel; a gear train to transmit the rotation of the flywheel to the drive axles; and traveling wheels installed on both ends of each of the drive axles.

33 Claims, 9 Drawing Sheets

MULTI-AXLE RUNNING TOY AND MULTI-AXLE RUNNING TOY SET

BACKGROUND OF THE INVENTION

1. Field of the Invention

The present invention relates to a multi-axle running toy which runs through inertial energy obtained when a flywheel is rotated, and a multi-axle running toy set including the multi-axle running toy.

2. Description of the Related Art

There have been provided various kinds of running toys such as toy cars which contain a flywheel that is rotated at a high-speed through a gear train when traveling wheels are rotated, and run through rotational energy of the flywheel which maintains rotation of the wheels.

For example, there is a toy car which is four-wheel-drive and the right and left front wheels of which are capable of moving upward and downward so that the toy car can run on an uneven surface even if the toy car is small and thus can add fun (for example, see Patent Document 1: Utility Model Gazette No. 3078134).

With regard to running toys based on earlier development which contain a flywheel, by running a small-sized toy shaped like a car or the like, the player can imagine him/herself moving a real car or the like. However, there has been a problem that moving a running toy based on earlier development lacks variation and thus lacks fun.

SUMMARY OF THE INVENTION

The present invention provides an interesting multi-axle running toy and a multi-axle running toy set which are capable of giving variation to running of the running body and of enabling the player to enjoy play of the imagination.

In accordance with a first aspect of the present invention, a multi-axle running toy comprising: a flywheel to serve as a driving source; three or more drive axles driven by rotation of the flywheel; a gear train to transmit the rotation of the flywheel to the drive axles; and traveling wheels installed on both ends of each of the drive axles.

The multi-axle running toy may further comprise wheel installation hubs provided on both ends of each of the drive axles, wherein the traveling wheels are removably installed on the drive axles through the wheel installation hubs.

Preferably, the wheel installation hubs are in a cylindrical shape.

According to the first aspect of the invention, the multi-axle running toy comprises three or more drive axles. Therefore, the toy shaped like a vehicle can easily run on an irregular ground. Moreover, when the toy is shaped like a bug, the toy looks as if a real bug is walking.

Moreover, when the traveling wheels are removably installed on the drive axles through the wheel installation hubs provided on both ends of each of the drive axles, the traveling wheels can be easily exchanged without fail. Hence, by changing the traveling wheels to wheels different in size or shape, the running speed or running state of the toy can be changed.

Preferably, at least one of the traveling wheels is an eccentric wheel whose rotation axis is deviated from a central axis of the at least one traveling wheels.

When at least one of the traveling wheels is an eccentric wheel, the toy can swingingly run.

Preferably, the number of the drive axles is three or four, the traveling wheels are different from each other in at least one of diameter, width, shape and external appearance, an installation hole through which a traveling wheel is removably installed on a drive axle is provided on a central axis of at least one of the traveling wheels, and the installation hole is provided in a position deviated from a central axis of at least one of the traveling wheels, thus changing a running speed or running state of the multi-axle running toy by changing a traveling wheel to another traveling wheel different in diameter, width, shape or external appearance.

When the number of the drive axles is three or four, and a traveling wheel is changeable to another traveling wheel different in shape or the like, the running speed or running state of the toy can be changed by changing the traveling wheels installed on the drive axles to a traveling wheel different in size, shape or the like.

Preferably, an installation hole is formed in a position on a central axis of a traveling wheel on a side thereof, and another installation hole is formed in a position deviated from the central axis of the traveling wheel on the other side of the traveling wheel.

When an installation hole is formed in a position on a central axis of a traveling wheel on a side thereof, and another installation hole is formed in a position deviated from the central axis of the traveling wheel on the other side of the traveling wheel, depending on the installation hole to be used, the traveling wheels can be eccentric wheels or wheels that rotate on the central axis thereof. Thus, the running speed or running state of the toy can be changed.

The multi-axle running toy may further comprise: an intermediate gear engaged with the gear train; and a charge wheel to charge kinetic energy to the flywheel through the intermediate gear.

When the toy comprises the charge wheel, which is different from the traveling wheel, the flywheel can be easily accelerated to be rotated at a high speed.

In accordance with a second aspect of the present invention, a multi-axle running toy set comprises: a flywheel to serve as a driving source; three or more drive axles driven by rotation of the flywheel; a gear train to transmit the rotation of the flywheel to the drive axles; and a plurality of wheel groups each of which includes traveling wheels twice the drive axles in number, to adapt to installation on both ends of each of the drive axles, wherein wheels in a wheel group are different from wheels in another wheel group in at least one of diameter, width, shape and external appearance.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DESCRIPTION OF THE PREFERRED EMBODIMENTS

A best mode for carrying out the invention is a multi-axle running toy comprising: a flywheel as a driving source; a plurality of drive axles to rotate integrally with drive gears by transmitting rotation reduced from the rotation of the flywheel through a gear train; eccentric wheels removably installed at both ends of the drive axles; and a charge wheel disposed through an intermediate gear engaged with the gear train. Here, part of the charge wheel is exposed to the rear of the toy.

Embodiments

Figure 1:
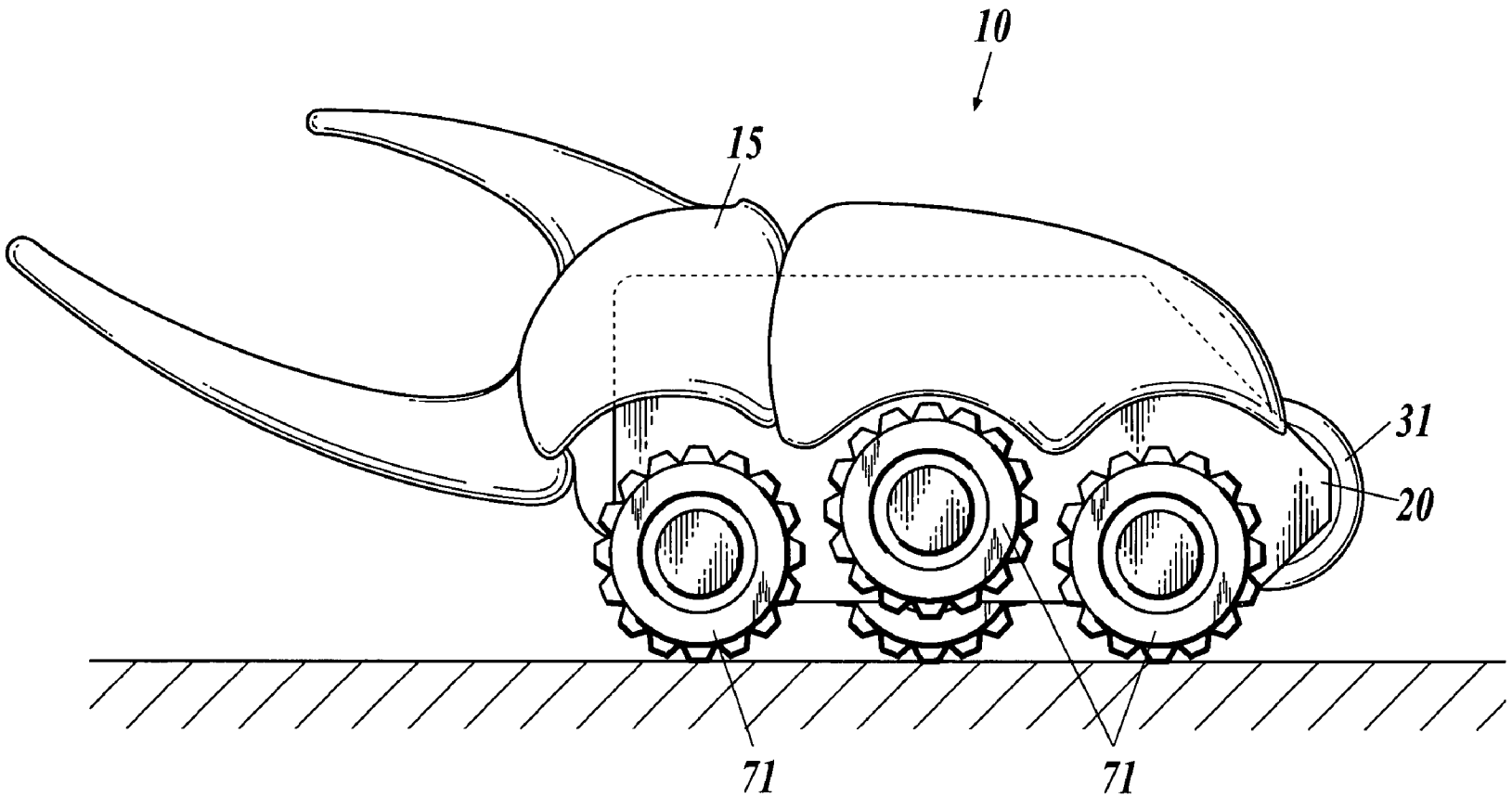
FIG. 1 is an external view showing an embodiment of a multi-axle running toy in accordance with the present invention.

As shown in FIG. 1, an embodiment of a multi-axle running toy according to the present invention is a running toy 10 which includes three traveling wheels as driving wheels 71 on each side of the running toy 10, and a charge wheel 31 part of which is exposed to the rear side of the running toy 10. The driving wheels 71 are eccentric wheels each provided with an installation hole 75 formed in a position deviated from the central position (position on a central axis) of the driving wheel 71. The installation hole 75 allows the driving wheels 71 to be installed on drive axles 65 via wheel installation hubs 67. In this embodiment, the wheel installation hubs 67 are in a cylindrical shape.

Figure 2:
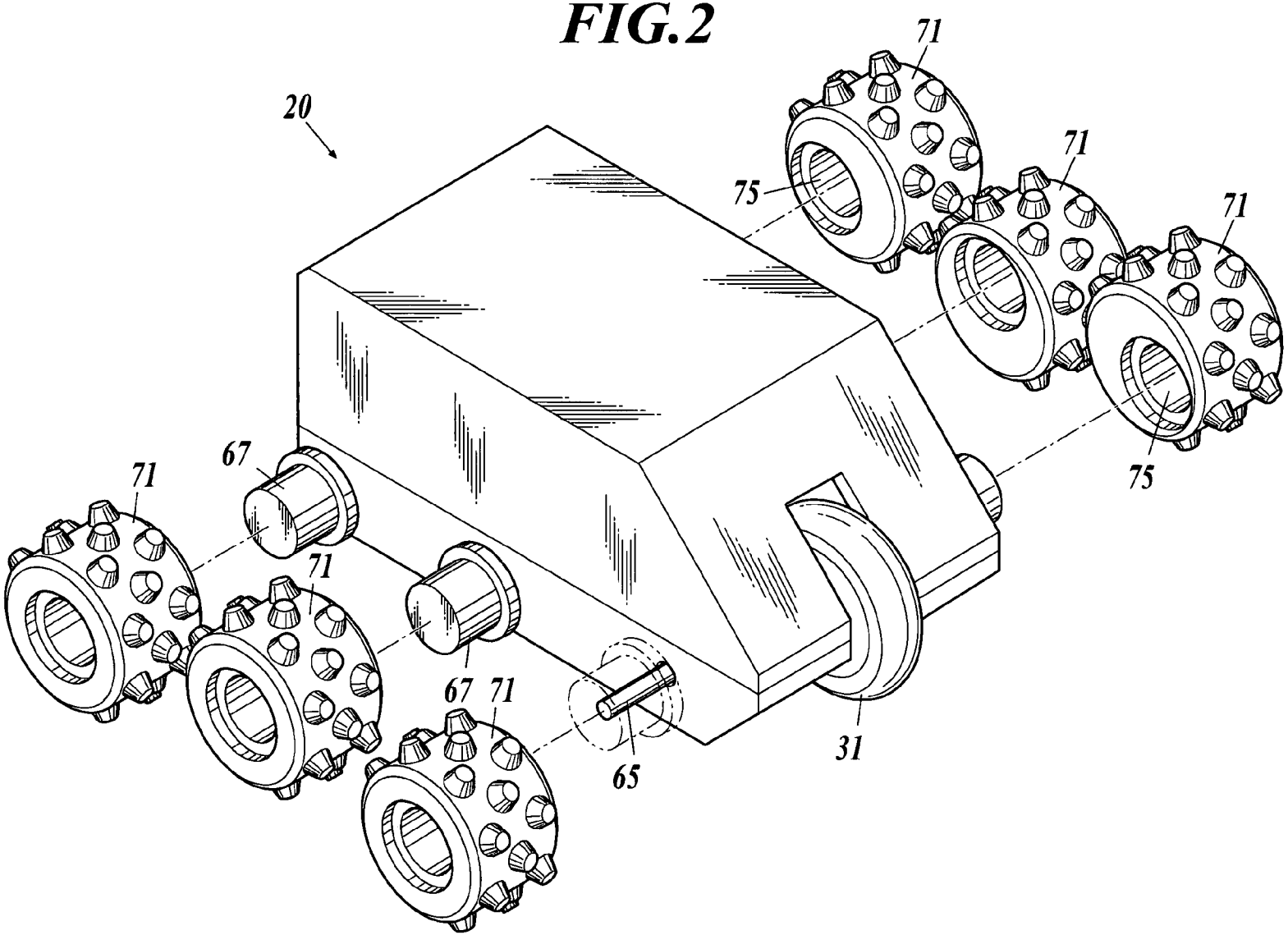
FIG. 2 is a view showing main part of the multi-axle running toy in accordance with the present invention.

The running toy 10 further includes a drive case 20 shown in FIG. 2 inside an outer shell cover 15 having a bug-like appearance.

The drive case 20 is box-shaped, and inside thereof there are included a flywheel 55 and a gear train to rotate the flywheel 55 at a speed higher than those of the driving wheels 71 serving as the traveling wheels and of the charge wheel 31. Three wheel installation hubs 67 through which the traveling wheels are installed protrude from each of the right and left sides of the box-shaped drive case 20.

Figure 3:
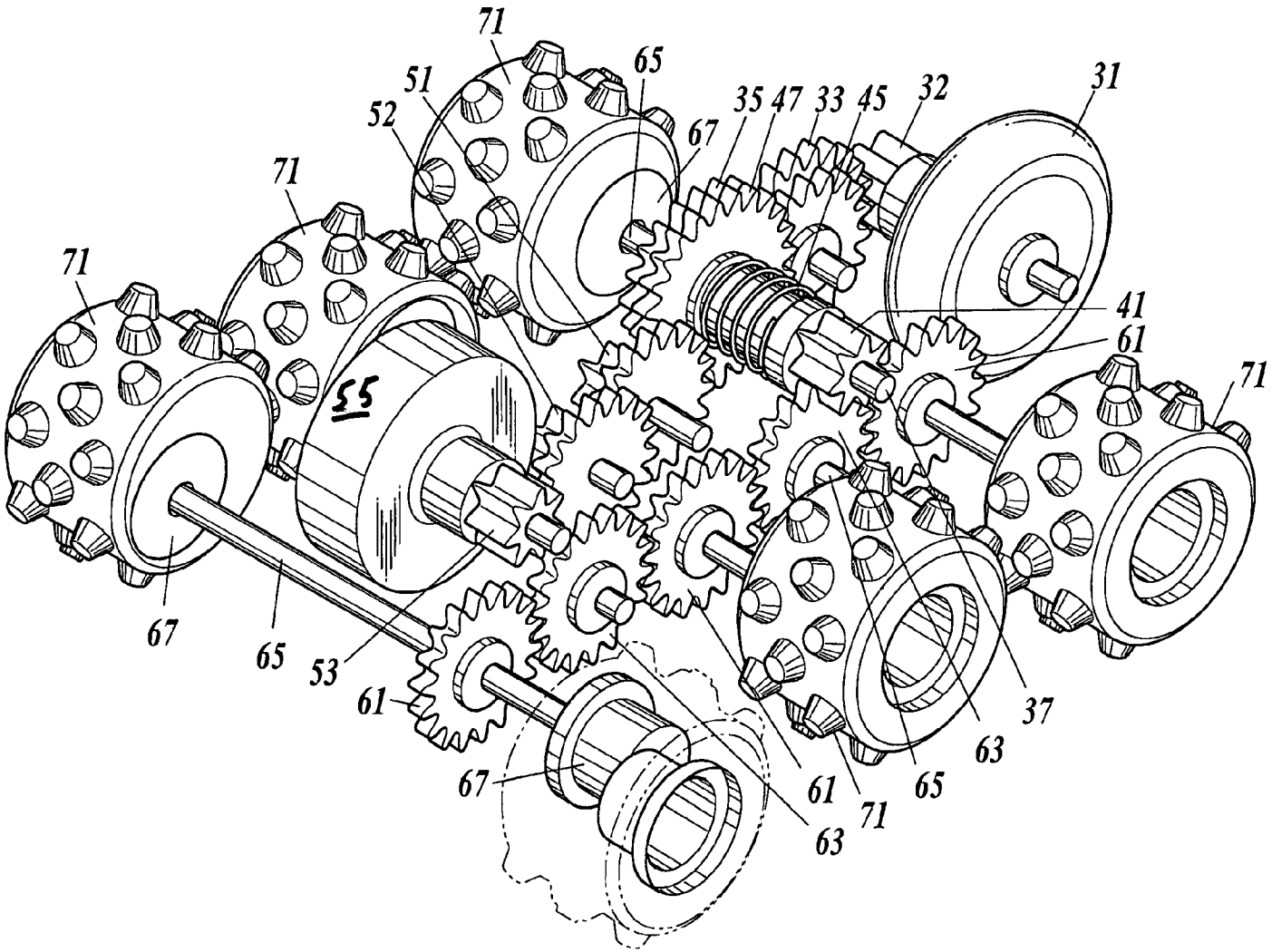
FIG. 3 is a view showing power system of the multi-axle running toy in accordance with the present invention.

More specifically, as shown in FIG. 3, the drive case 20 contains the flywheel 55, first and second acceleration gears 51 and 52, a clutch gear 47, a charge transmission gear 35, a drive transmission gear 41, an intermediate gear 33, three drive gears 61, and two idle gears 63.

A charge cannon 32, which rotates integrally with the charge wheel 31, and the intermediate gear 33 are engaged with each other, and rotation of the charge wheel 31 is transmitted to the charge transmission gear 35 through the intermediate gear 33. A transmission axle 37 and the drive transmission gear 41 are rotated integrally with the charge transmission gear 35, and the rotation of the transmission axle 37 is transmitted to the clutch gear 47 through a clutch 45, thereby rotating the clutch gear 47.

The clutch gear 47 is engaged with a small-diameter cannon of the first acceleration gear 51, and a large-diameter cannon of the first acceleration gear 51 is engaged with a small-diameter cannon of the second acceleration gear 52. A large-diameter cannon of the second acceleration gear 52 is engaged with a wheel gear 53. The wheel gear 53 is rotated at a speed higher than that of the clutch gear 47 through the gear train of the first and second acceleration gears 51 and 52, whereby the flywheel 55, which rotates integrally with the wheel gear 53, is allowed to rotate at a high speed.

The drive transmission gear 41 is engaged with one of the idle gears 63. This idle gear 63 is engaged with two of the drive gears 61 which rotate integrally with the drive axles 65 on which the traveling wheels are installed. One of the two drive gears 61 is engaged with the other idle gear 63, and this idle gear 63 is engaged with the other drive gear 61.

Thus, the drive gears 61 attached to the three drive axles 65 are rotatable at substantially the same speed in the same direction through the idle gears 63.

At both ends of the respective drive axles 65, the wheel installation hubs 67 are provided. The diameter of the wheel installation hubs 67 is made large so that the traveling wheels, namely, the driving wheels 71, can be easily installed on and removed from the drive axles 65 without fail. At the same time, it is easy to fixedly position the drive axles 65 upon incorporation of the drive axles 65 into the drive case 20.

In the embodiment shown in FIG. 3, the clutch 45 is provided between the transmission axle 37 and the clutch gear 47. When rotation of the charge wheel 31 or the driving wheels 71 is suddenly stopped during rotation of the charge wheel 31 or the driving wheels 71, the clutch 45 is slid, thereby preventing sudden stop of the rotations of the clutch gear 47, the first and second acceleration gears 51 and 52, the wheel gear 53 and the flywheel 55. Thus, damage to the gears caused due to inertia of the flywheel 55 rotating at a high speed is prevented.

A large-diameter cannon of the intermediate gear 33 is engaged with the charge cannon 32 that is integral with the charge wheel 31, and a small-diameter cannon of the intermediate gear 33 is engaged with the charge transmission gear 35. The speed reducing ratio from the flywheel 55 to the charge wheel 31 is made smaller than that from the flywheel 55 to the drive wheels 71. Thus, the rotation speed of the charge wheel 31 is made to be a rotation speed suitable to accelerating the flywheel 55.

Figure 4A:
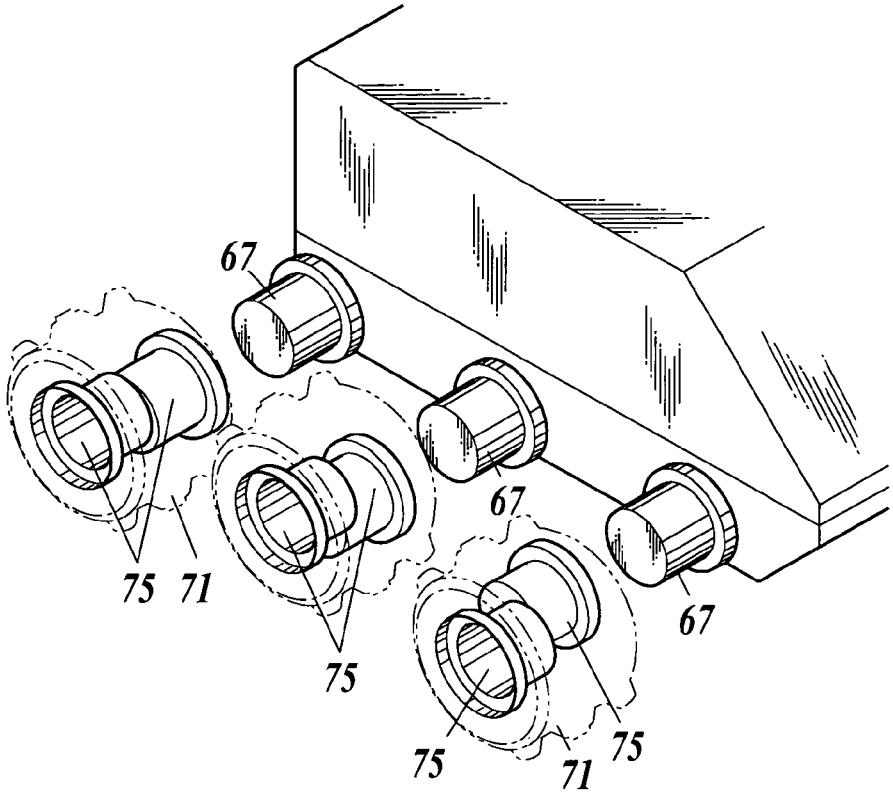
FIGS. 4A and 4B are views showing examples of wheels of the multi-axle running toy in accordance with the present invention.
Figure 4B:
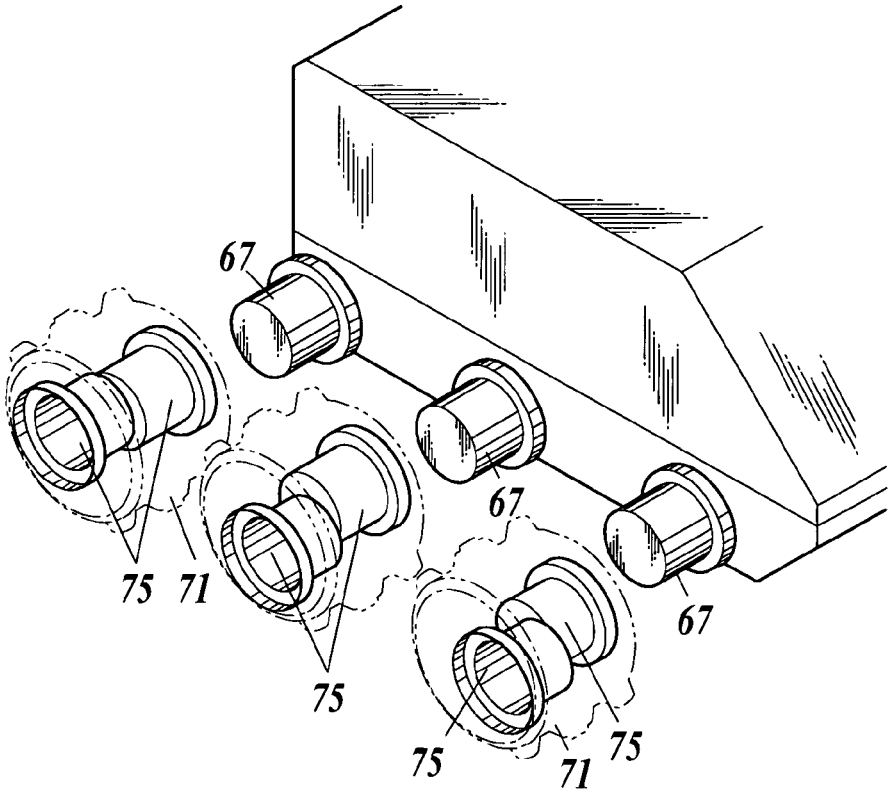

In this embodiment, the traveling wheels which are installed on and removed from the wheel installation hubs 67 are not only eccentric wheels provided with the installation holes 75 formed in a position deviated from the central position of the wheels. As shown in FIGS. 4A and 4B, an installation hole 75 in which the wheel installation hub 67 is inserted may be formed from one side of a traveling wheel to the middle of the traveling wheel in a position deviated from the central position of the wheel, while another installation hole 75 in which the wheel installation hub 67 is inserted may be formed from the other side of the traveling wheel to the middle of the traveling wheel in the central position of the wheel.

In this case, as shown in FIG. 4A, when the wheel installation hubs 67 are inserted in the installation holes 75 provided in a position deviated from the central position of the wheel, the driving wheels 71 serving as the traveling wheels eccentrically rotate through rotation of the drive axles 65. As shown in FIG. 1, with some driving wheels 71 out of six being away from the running surface, the running toy 10 performs unstable running. The running toy 10 thus can swingingly run even on a flat running surface. Alternatively, as shown in FIG. 4B, when the wheel installation hubs 67 are inserted in the installation holes 75 provided in the central position of the wheels, all six traveling wheels, namely, the driving wheels 71, are always in contact with the flat running surface. Thus, stable running can be performed.

In a case where an installation hole 75 is provided in the central position of a traveling wheel on one side of the traveling wheel and another installation hole 75 is provided in a position deviated from the central position of the traveling wheel on the other side of the traveling wheel, it is sufficient to allow the depth of each installation hole 75 to meet the length of the wheel installation hub 67 in the axis direction of the wheel installation hub 67.

With regard to a case where eccentric wheels having the installation holes 75 in a position deviated from the central position of the wheel are installed on the drive axles 65, when the degrees of eccentricity are substantially the same among the eccentric wheels, the toy is allowed to run moving up and down while keeping a certain posture as a whole. In contrast, when the degrees of eccentricity of the traveling wheels are different among the wheels, the toy swings and moves up and down, thereby varying the running state of the toy.

Alternatively, when there are six driving wheels 71 and at least one of the six driving wheels 71 is an eccentric wheel that rotates eccentrically, the running toy 10 runs with part of the running toy 10 moving up and down in accordance with the position of the eccentric wheel(s) installed. Thus, in accordance with the number and positions of the traveling wheel(s) that rotate eccentrically, the running toy 10 performs various swings and up and down movement.

Figure 5:
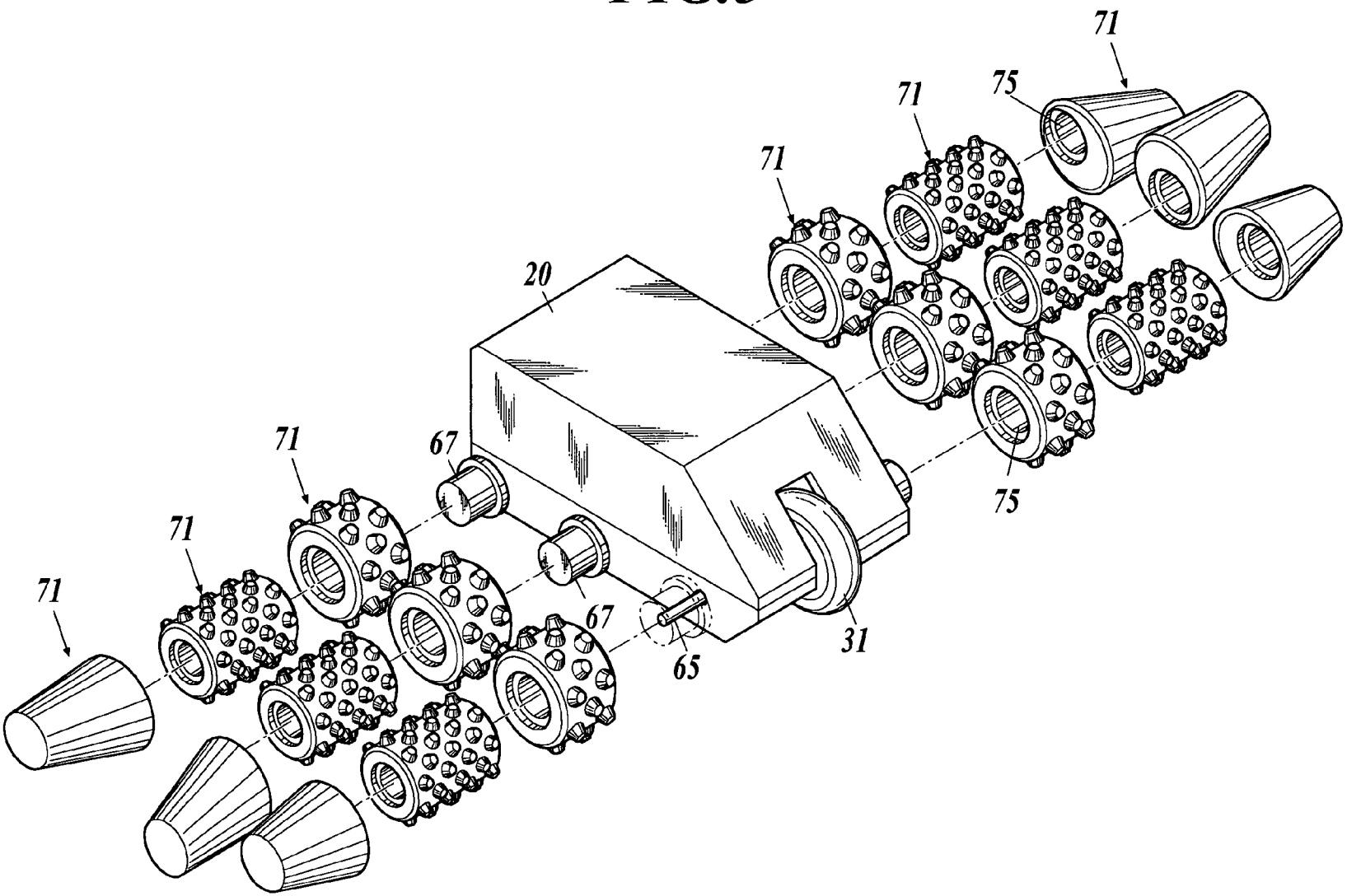
FIG. 5 is a view showing an example of a combination of wheels of the multi-axle running toy in accordance with the present invention.

The traveling wheels serving as the driving wheels 71 are not limited to a wheel having an installation hole 75 provided in the central position of the wheel and another installation hole 75 provided in a position deviated from the central position of the wheel. As shown in FIG. 5, six wheels having substantially the same shape with each other may be combined as a set of wheels in a multiple of the number of the drive axles 65. Here, a set of wheels each having the installation hole 75 in the central position of the wheels and an outer diameter different from another set of wheels may be combined to be attached to the main body of the running toy 10. A set of wheels whose width, namely, a length in the rotary axis direction thereof, is different from that of another set of wheels may be combined. A set of wheels having an inclined circular truncated cone shape and provided with the installation hole 75 in a position eccentric in a direction opposite to the inclination direction may be combined to be attached to the main body of the running toy 10. Although not illustrated, a set of wheels in a rectangular column shape or a cylindrical shape each end of which is bent to be down-turned to have a shape like a leg of a bug, and each of which is provided with the installation hole 75 at a base portion thereof may be combined to be attached to the main body of the running toy 10. Thus, various combinations of traveling wheels to be attached to the main body of the running toy 10 may be formed.

When such sets of six traveling wheels substantially in the same shape that are installable on and removable from the drive axles 65 are provided and each set is different from each other in shape, diameter, or external appearance, the running speed of the toy can be changed when the traveling wheels attached to the drive axles 65 are changed to traveling wheels having a diameter different from the former wheels, and the stability of running of the toy can be changed when the traveling wheels attached to the drive axles 65 are changed to traveling wheels having a width different from the former wheels. Moreover, the toy becomes capable of swinging or moving up and down when the attached wheels are changed to wheels different in shape, to eccentric wheels, or the like. Thus, by changing the wheels, the running state of the toy can be varied.

In a case where six traveling wheels are installed on both ends of three drive axles 65, the six traveling wheels are not limited to the wheels having substantially the same shape. Traveling wheels different in shape or width may be combined to be installed on the drive axles 65, whereby the running state of the toy can be changed in a complicated way.

Figure 6:
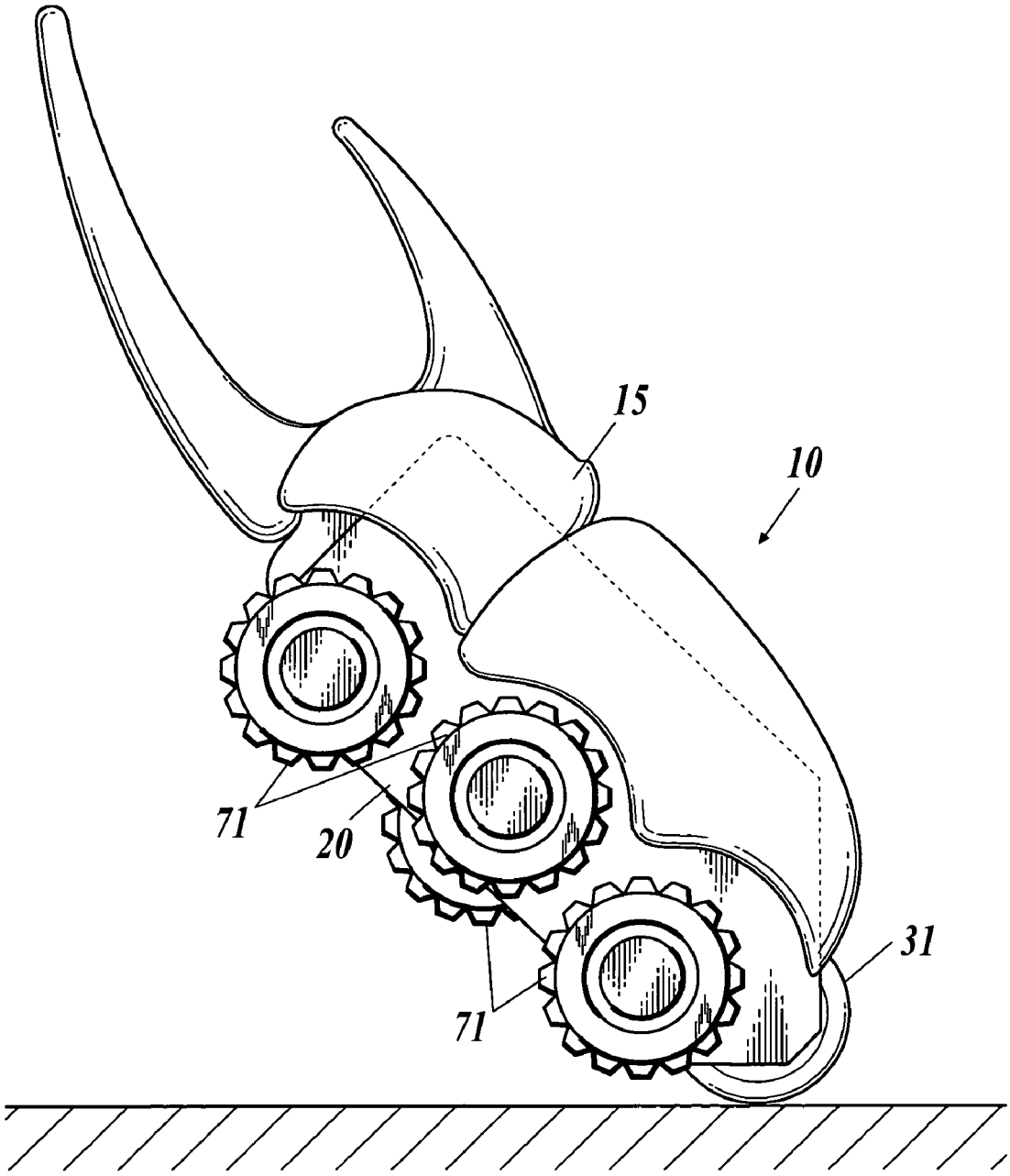
FIG. 6 is a view showing an example of use of the multi-axle running toy in accordance with the present invention.

As shown in FIG. 6, by bringing into contact with the ground the charge wheel 31 part of which is exposed to the rear of the toy, and by moving the running toy 10 to rotate the charge wheel 31, the flywheel 55 of the running toy 10 can be charged with kinetic energy.

Upon charging the flywheel 55 with kinetic energy by rotating the flywheel 55 through the charge wheel 31, if the traveling wheels serving as the driving wheels 71 are eccentric wheels, the main body of the toy will swing if the driving wheels 71 are in contact with the ground. However, by rotating the charge wheel 31 on the ground with the driving wheels 71 away from the running surface, the charge wheel 31 can be easily rotated in a state of being in contact with the ground even when the inclination angle of the running toy 10 is changed a little to the front, rear, right and left, since the number of the charge wheel 31 is one and the rotary axis of the charge wheel 31 is in the middle of the wheel. Thus, it becomes easy to sequentially accelerate the flywheel 55 to rotate the flywheel 55 at a high speed.

After the flywheel 55 is rotated at a high speed, the running toy 10 is put on a running surface such that the traveling wheels of the running toy 10 are in contact with the ground, and then released from a hand. The running toy 10 then runs through rotation of the driving wheels 71. The running toy 10 runs while swinging in accordance with the shape of the driving wheels 71 serving as the traveling wheels, or runs while moving up and down.

The intermediate gear 33 is a gear having a large-diameter cannon and a small-diameter cannon, and allows rotation of the charge wheel 31 to be faster than that of the driving wheels 71. Thus, the running speed of the running toy 10 is made slower than that of the charge wheel 31 when rotation of the flywheel 55 is accelerated with the charge wheel 31 being in contact with the ground. In this way, the up-down motion and swinging motion of the running toy 10 can be assured.

Figure 7:
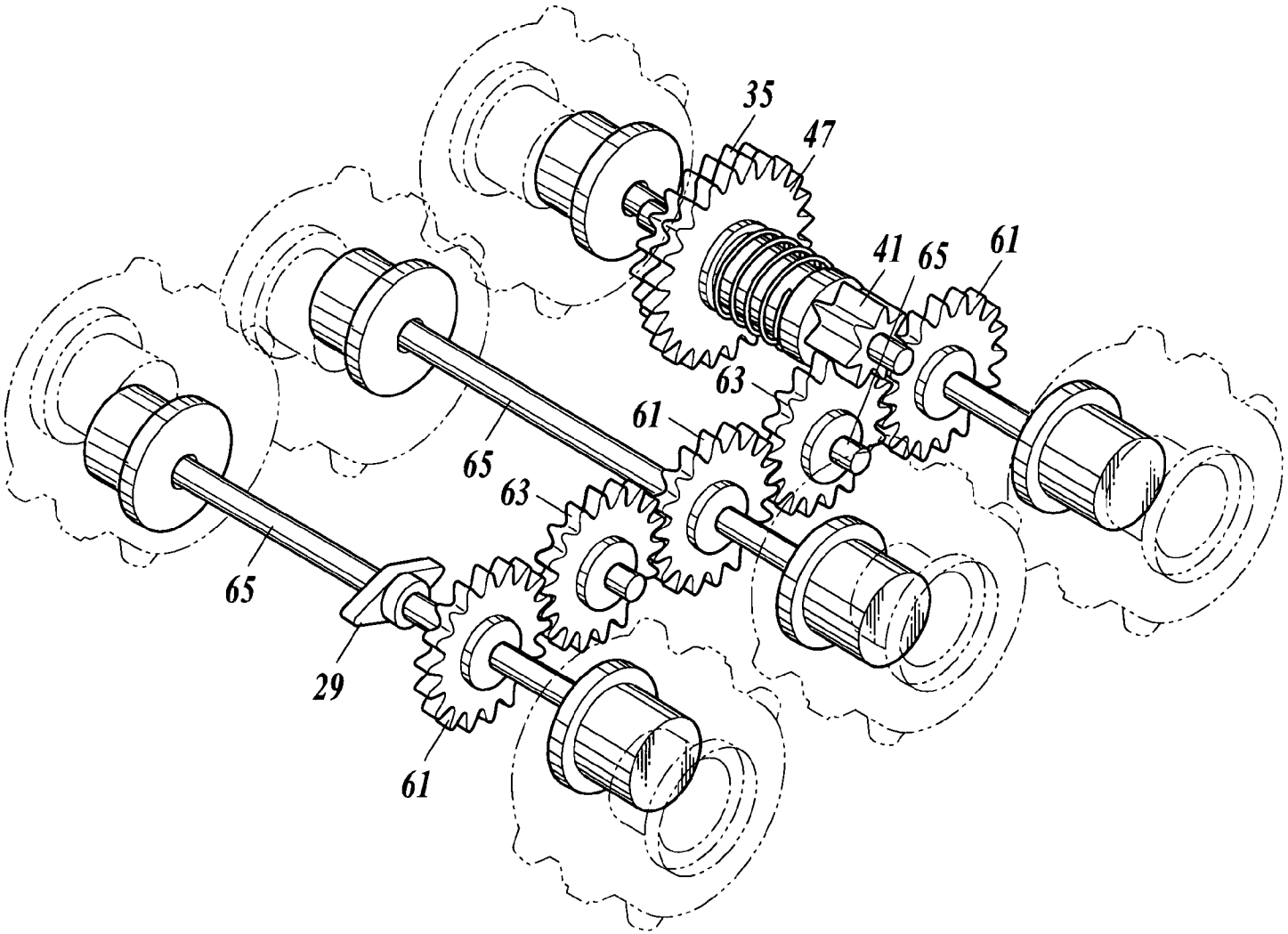
FIG. 7 is a view showing another embodiment of the multi-axle running toy in accordance with the present invention.
Figure 8:
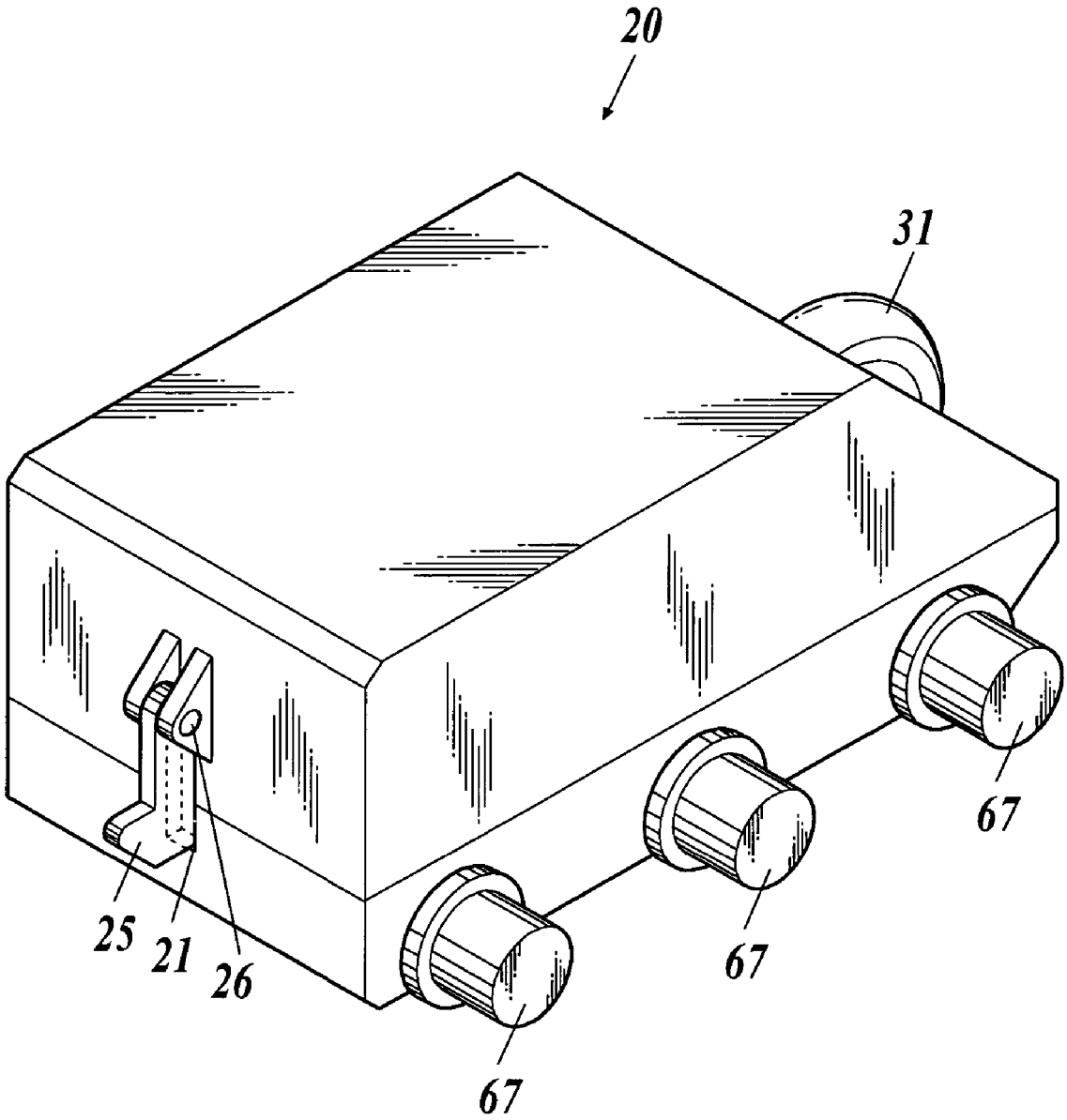
FIG. 8 is a view showing a drive case of the another embodiment of the multi-axle running toy in accordance with the present invention.

According to another embodiment, as shown in FIG. 7, an oval swing cam 29 may be provided on one of the drive axles 65. As shown in FIG. 8, a slit 21 may be provided on a front end of the drive case 20, an L-shaped swing body 25 may be inserted through the slit 21, and the vicinity of a top end of the swing body 25 may be supported by a stick-like swing pin 26. Thus, the lower portion of the swing body 25 is allowed to swing frontward and rearward. In this way, the inner surface of the swing body 25 may be brought into contact with the swing cam 29.

In this embodiment, when the toy runs with an outer shell cover 15 covering the drive case 20, the lower portion of the swing body 25 swings frontward and rearward in accordance with the rotation of the swing cam 29, and a protruding portion that protrudes front downward of the swing body 25 pushes out part of the outer shell cover 15 frontward. Thus, part of the outer shell cover 15 and the like can be periodically moved.

Figure 9:
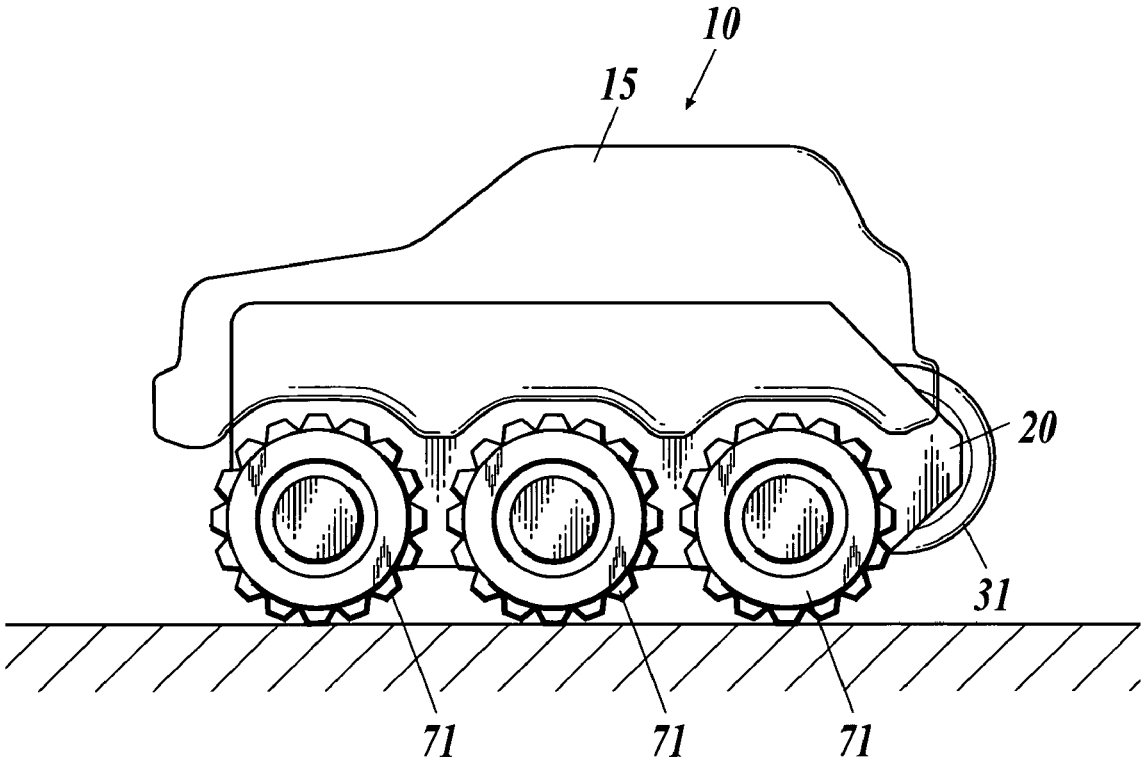
FIG. 9 is a view showing another external view of the multi-axle running toy in accordance with the present invention.

The outer shell cover 15 is not limited to a shape of a living body such as a bug. For example, as shown in FIG. 9, the outer shell cover 15 may be in a shape of a vehicle.

In the above embodiment, the running toy 10 is a six-wheel-drive toy having three drive axles 65. However, the number of the drive axles 65 having the drive gears 61 rotated through the idle gears 63 may be increased, and the running toy 10 may be made into an eight-wheel-drive or ten-wheel-drive toy.

However, swinging and up-down motion of the running toy 10 with eccentric wheels can be largely changed when the running toy 10 is six-wheel-drive or eight-wheel-drive. Moreover, when the running toy 10 is six-wheel-drive or eight-wheel-drive and the shape of the running toy 10 is of a living body such as a bug, the running toy 10 can be vividly associated with a real bug.

The intermediate gear 33 may be a transmission gear made up of one gear which only transmits rotation between the charge cannon 32 and the transmission gear 35.

The driving wheels 71 may be installed directly on the drive axles 65 without using the wheel installation hubs 67. In case of the running toy 10 using eccentric wheels, the driving wheels 71 may be fixedly installed on the drive axles 65.

The running toy according to the present invention includes three or more drive axles and a flywheel as a driving source. Thus, the running toy runs in accordance with inertia of the flywheel. Since the running toy is multi-axle drive, highly stable running is available through traveling wheels serving as driving wheels. Moreover, the running body may swing to give variation to the way of running of the toy, and thus the player can play with the running toy with fun.

The entire disclosure of Japanese Patent Application No. Tokugan 2003-364965 filed on Oct. 24, 2003 including specification, claims, drawings and summary are incorporated herein by reference in its entirety.

What is claimed is:

1. A multi-axle running toy comprising:

a flywheel to serve as a driving source;

three or more drive axles driven by rotation of the flywheel;

a gear train to transmit the rotation of the flywheel to the drive axles; and traveling wheels installed on both ends of each of the drive axles, wherein at least one of the traveling wheels is an eccentric wheel whose rotation axis is deviated from a central axis of the at least one of the traveling wheels, wherein each of the traveling wheels is provided with an installation hole through which a traveling wheel is removably installed on the drive axle, and wherein the installation hole is formed in a position on the central axis of the traveling wheel on a side thereof, and another installation hole is formed in a position deviated from the central axis of the traveling wheel on the other side of the traveling wheel.

2. A multi-axle running toy comprising:

a flywheel to serve as a driving source;

three or more drive axles driven by rotation of the flywheel;

a gear train to transmit the rotation of the flywheel to the drive axles; and traveling wheels installed on both ends of each of the drive axles, wherein at least one of the traveling wheels is an eccentric wheel whose rotation axis is deviated from a central axis of the at least one of the traveling wheels, wherein the number of the drive axles is three or four, the traveling wheels are different from each other in at least one of diameter, width, shape and external appearance, an installation hole through which a traveling wheel is removably installed on a drive axle is provided on a central axis of at least one of the traveling wheels, and the installation hole is provided in a position deviated from a central axis of at least one of the traveling wheels, thus changing a running speed or running state of the multi-axle running toy by changing a traveling wheel to another traveling wheel different in diameter, width, shape or external appearance.

3. A multi-axle running toy comprising:

a flywheel to serve as a driving source;

three or more drive axles driven by rotation of the flywheel;

a gear train to transmit the rotation of the flywheel to the drive axles; and traveling wheels installed on both ends of each of the drive axles, wherein at least one of the traveling wheels is an eccentric wheel whose rotation axis is deviated from a central axis of the at least one of the traveling wheels, wherein an installation hole is formed in a position on a central axis of a traveling wheel on a side thereof, and another installation hole is formed in a position deviated from the central axis of the traveling wheel on the other side of the traveling wheel, thus changing a running state of the multi-axle running toy by changing the installation hole.

4. A multi-axle running toy comprising:

a flywheel to serve as a driving source;

three or more drive axles driven by rotation of the flywheel;

a gear train to transmit the rotation of the flywheel to the drive axles; and traveling wheels installed on both ends of each of the drive axles, wherein each of the traveling wheels is provided with an installation hole through which a traveling wheel is removably installed on a drive axle, and wherein one of the installation holes is formed in a position on a central axis of a traveling wheel on a side thereof, and another one of the installation holes is formed in a position deviated from the central axis of the traveling wheel on an opposite side of the traveling wheel.

5. The multi-axle running toy as claimed in claim 4, further comprising wheel installation hubs provided on both ends of each of the drive axles, wherein the traveling wheels are removably installed on the drive axles through the wheel installation hubs.

6. The multi-axle running toy as claimed in claim 4, wherein the wheel installation hubs are in a cylindrical shape.

7. The multi-axle running toy as claimed in claim 4, wherein the traveling wheels are directly installed on the drive axles.

8. The multi-axle running toy as claimed in claim 4, further comprising:

an intermediate gear engaged with the gear train; and a charge wheel to charge kinetic energy to the flywheel through the intermediate gear.

9. The multi-axle running toy as claimed in claim 8, wherein the intermediate gear includes a large-diameter gear and a small-diameter gear.

10. The multi-axle running toy as claimed in claim 8, wherein the intermediate gear is made up of one gear.

11. The multi-axle running toy as claimed in claim 4, further comprising:

a swing cam provided on one of the drive axles;

a swing body to contact with the swing cam;

a drive case to contain the gear train; and an outer shell cover to contain the drive case, wherein the swing body swings in accordance with rotation of the swing cam, thus moving part of the outer shell cover.

12. A multi-axle running toy comprising:

a flywheel to serve as a driving source;

three or more drive axles driven by rotation of the flywheel;

a gear train to transmit the rotation of the flywheel to the drive axles; and traveling wheels installed on both ends of each of the drive axles, wherein the number of the drive axles is three or four, the traveling wheels are different from each other in at least one of diameter, width, shape and external appearance, an installation hole through which a traveling wheel is removably installed on a drive axle is provided on a central axis of at least one of the traveling wheels, and the installation hole is provided in a position deviated from a central axis of at least one of the traveling wheels, thus changing a running speed or running state of the multi-axle running toy by changing a traveling wheel to another traveling wheel different in diameter, width, shape or external appearance.

13. The multi-axle running toy as claimed in claim 12, further comprising wheel installation hubs provided on both ends of each of the drive axles, wherein the traveling wheels are removably installed on the drive axles through the wheel installation hubs.

14. The multi-axle running toy as claimed in claim 12, wherein the wheel installation hubs are in a cylindrical shape.

15. The multi-axle running toy as claimed in claim 12, wherein the traveling wheels are directly installed on the drive axles.

16. The multi-axle running toy as claimed in claim 12, further comprising:

an intermediate gear engaged with the gear train; and a charge wheel to charge kinetic energy to the flywheel through the intermediate gear.

17. The multi-axle running toy as claimed in claim 16, wherein the intermediate gear includes a large-diameter gear and a small-diameter gear.

18. The multi-axle running toy as claimed in claim 16, wherein the intermediate gear is made up of one gear.

19. The multi-axle running toy as claimed in claim 12, further comprising:

a swing cam provided on one of the drive axles;

a swing body to contact with the swing cam;

a drive case to contain the gear train; and an outer shell cover to contain the drive case, wherein the swing body swings in accordance with rotation of the swing cam, thus moving part of the outer shell cover.

20. A multi-axle running toy comprising:

a flywheel to serve as a driving source;

three or more drive axles driven by rotation of the flywheel;

a gear train to transmit the rotation of the flywheel to the drive axles; and traveling wheels installed on both ends of each of the drive axles, wherein an installation hole is formed in a position on a central axis of a traveling wheel on a side thereof, and another installation hole is formed in a position deviated from the central axis of the traveling wheel on the other side of the traveling wheel, thus changing a running state of the multi-axle running toy by changing the installation hole.

21. The multi-axle running toy as claimed in claim 20, further comprising wheel installation hubs provided on both ends of each of the drive axles, wherein the traveling wheels are removably installed on the drive axles through the wheel installation hubs.

22. The multi-axle running toy as claimed in claim 20, wherein the wheel installation hubs are in a cylindrical shape.

23. The multi-axle running toy as claimed in claim 20, wherein the traveling wheels are directly installed on the drive axles.

24. The multi-axle running toy as claimed in claim 20, further comprising:

an intermediate gear engaged with the gear train; and a charge wheel to charge kinetic energy to the flywheel through the intermediate gear.

25. The multi-axle running toy as claimed in claim 24, wherein the intermediate gear includes a large-diameter gear and a small-diameter gear.

26. The multi-axle running toy as claimed in claim 24, wherein the intermediate gear is made up of one gear.

27. The multi-axle running toy as claimed in claim 20, further comprising:

a swing cam provided on one of the drive axles;

a swing body to contact with the swing cam;

a drive case to contain the gear train; and an outer shell cover to contain the drive case, wherein the swing body swings in accordance with rotation of the swing cam, thus moving part of the outer shell cover.

28. A multi-axle running toy comprising:

a flywheel to serve as a driving source;

three or more drive axles driven by rotation of the flywheel;

a gear train to transmit the rotation of the flywheel to the drive axles, wherein each of the traveling wheels is an eccentric wheel, and the traveling wheels have substantially the same degree of eccentricity with each other;

an intermediate gear engaged with the gear train; and a charge wheel to charge kinetic energy to the flywheel through the intermediate gear.

29. The multi-axle running toy as claimed in claim 28, wherein the intermediate gear includes a large-diameter gear and a small-diameter gear.

30. The multi-axle running toy as claimed in claim 28, wherein the intermediate gear is made up of one gear.

31. A multi-axle running toy comprising:

a flywheel to serve as a driving source;

three or more drive axles driven by rotation of the flywheel;

a gear train to transmit the rotation of the flywheel to the drive axles;

traveling wheels installed on both ends of each of the drive axles, wherein each of the traveling wheels is an eccentric wheel, and at least one of the traveling wheels has a degree of eccentricity different from those of the other traveling wheels;

an intermediate gear engaged with the gear train; and a charge wheel to charge kinetic energy to the flywheel through the intermediate gear.

32. The multi-axle running toy as claimed in claim 31, wherein the intermediate gear includes a large-diameter gear and a small-diameter gear.

33. The multi-axle running toy as claimed in claim 31, wherein the intermediate gear is made up of one gear.

* * * * *